US005644824A

United States Patent [19]

Crosta

[11] Patent Number: 5,644,824

[45] Date of Patent: Jul. 8, 1997

[54] MAINTENANCE RAISING MACHINE INCLUDING A SAFETY DEVICE FOR PREVENTING DAMAGES AS THE FABRIC BEING RAISED IS BROKEN

[76] Inventor: Emanuele Crosta, Corso Sempione, 67, 21052 - Busto Arsizio (Varese), Italy

[21] Appl. No.: 629,480

[22] Filed: Apr. 10, 1996

[30] Foreign Application Priority Data

Sep. 26, 1995 [IT] Italy ..... MI95A1980

[51] Int. Cl.[6] ..... D06C 11/00

[52] U.S. Cl. ..... 26/33

[58] Field of Search ..... 26/33, 34, 32, 26/29 R, 31

[56] References Cited

U.S. PATENT DOCUMENTS

| | | | |
|---|---|---|---|
| 377,151 | 1/1888 | Grosselin | 26/34 |
| 393,605 | 11/1888 | Bauche | 26/33 |
| 485,929 | 4/1892 | Grosselin | 26/34 |
| 511,609 | 12/1893 | Gessner | 26/33 |
| 532,940 | 1/1895 | Bauche | 26/33 |
| 577,602 | 2/1897 | Grosselin | 26/33 |
| 1,154,350 | 9/1915 | Thiel | 26/33 |
| 5,526,557 | 6/1996 | Dalla Vecchia | 26/33 |

FOREIGN PATENT DOCUMENTS

| | | | |
|---|---|---|---|
| 738620 | 7/1943 | Germany | 26/33 |
| 1137713 | 10/1962 | Germany | 26/33 |

*Primary Examiner*—Amy B. Vanatta
*Attorney, Agent, or Firm*—Bucknam and Archer

[57] ABSTRACT

The present invention relates to an improved maintenance raising machine including a safety device for preventing damages as the fabric being raised is broken.

The raising machine comprises a horizontal axis drum which can be rotatively driven about its rotary axis and which supports, on the periphery thereof, a plurality of raising cylinders, which have cylinder axes parallel to the drum axis and are rotatively driven about the respective axes. With a portion of the drum are associated cleaning brushes which can operate on the raising cylinders for cleaning the latter. The cleaning brushes are mounted on a controllably driven support which can be displaced toward or away from the drum in order to facilitate the maintenance of the raising machine to prevent damages to the brushes of the raising cylinder covers as a fabric being raised is accidentally broken.

3 Claims, 4 Drawing Sheets

MAINTENANCE RAISING MACHINE INCLUDING A SAFETY DEVICE FOR PREVENTING DAMAGES AS THE FABRIC BEING RAISED IS BROKEN

BACKGROUND OF THE INVENTION

The present invention relates to an improved maintenance raising machine including a safety device for preventing damages as the fabric being raised is broken.

As is known, for raising fabrics, are conventionally used specifically designed machines, which are called raising or teaseling machines.

Prior art raising machines usually comprise a drum, which has a horizontal axis and supports, on the periphery or mantle thereof, a plurality of raising cylinders, constituted by cylinders having the axes thereof parallel to the axis of the drum and coated by card clothings.

Usually, the mentioned raising cylinders are kinematically connected to the drum, so that a rotation of the drum about the axis thereof will also cause the rotation of the raising cylinders about the respective rotary axes.

This connection is so designed that, alternately, two adjoining raising cylinders are driven in opposite turning directions and the card clothings of two adjoining raising cylinders have the tips of the teeth thereof directed in a mutually opposite direction in order to respectively perform a raising operation and a counter-raising operation on the fabric being raised.

The fabric being raised, during the advancement movement thereof, is wound nearly on the overall periphery of the drum supporting the raising cylinders, with the exclusion of a bottom region of the drum periphery or mantle, where are arranged one or more cleaning brushes, for cleaning the card clothings of the raising cylinders.

The cleaning brushes are conventionally driven by opposite rotary movements and are so arranged as to affect one the raising cylinder for performing the raising operation proper, and the other the raising cylinders for performing the counter-raising operation.

The above mentioned prior art raising machines are affected by the problem that a possible damage of the machine can occur as a fabric being raised is accidentally broken.

In fact, as a breakage of the fabric occurs, the fabric may contact the cleaning brushes so as to damage the latter, or damage the raising cylinder card clothings, with the requirement of subjecting the assembly to frequent maintenance operations, in order to replace the brushes and, very frequently, also the raising cylinder card clothings.

SUMMARY OF THE INVENTION

Accordingly, the aim of the present invention is to solve the above mentioned problem, by providing a raising machine which is very safe against a possible damage of the cleaning brushes and card clothings of the raising cylinders, as a fabric being raised is accidentally broken.

Within the scope of the above mentioned aim, a main object of the present invention is to provide such a raising machine the maintenance thereof can be performed very easily and quickly.

Another object of the present invention is to provide such a raising machine which is very safe and reliable in operation.

Yet another object of the present invention is to provide such a raising machine which can be made starting from easily available materials and elements and which, moreover, has a very reduced cost.

According to one aspect of the present invention, the above mentioned aim and objects, as well as yet other objects, which will become more apparent hereinafter, are achieved by an improved maintenance raising machine, including a safety device for preventing damages as a fabric being raised is broken, said raising machine comprising a drum, having a horizontal axis, which can be rotatably driven about said axis and supporting, on a peripheral portion thereof, a plurality of raising cylinders, having cylinder axes parallel to said axis of said drum and which can be rotatively driven about the axes thereof, one or more cleaning brushes being moreover provided, said brushes adjoining a portion of said periphery of said drum and operating on said raising cylinders for cleaning said raising cylinders, characterized in that said cleaning brushes are mounted on a controllably driven support element which can be displaced toward said drum or away from said drum.

BRIEF DESCRIPTION OF THE DRAWINGS

Further characteristics and advantages of the raising machine according to the present invention will become more apparent hereinafter from the following detailed disclosure of a preferred, though not exclusive, embodiment of said raising machine which is illustrated, by a merely indicative, but not limitative example, in the figures of the accompanying drawings, where.

DESCRIPTION OF THE PREFERRED EMBODIMENTS

Figure 1:
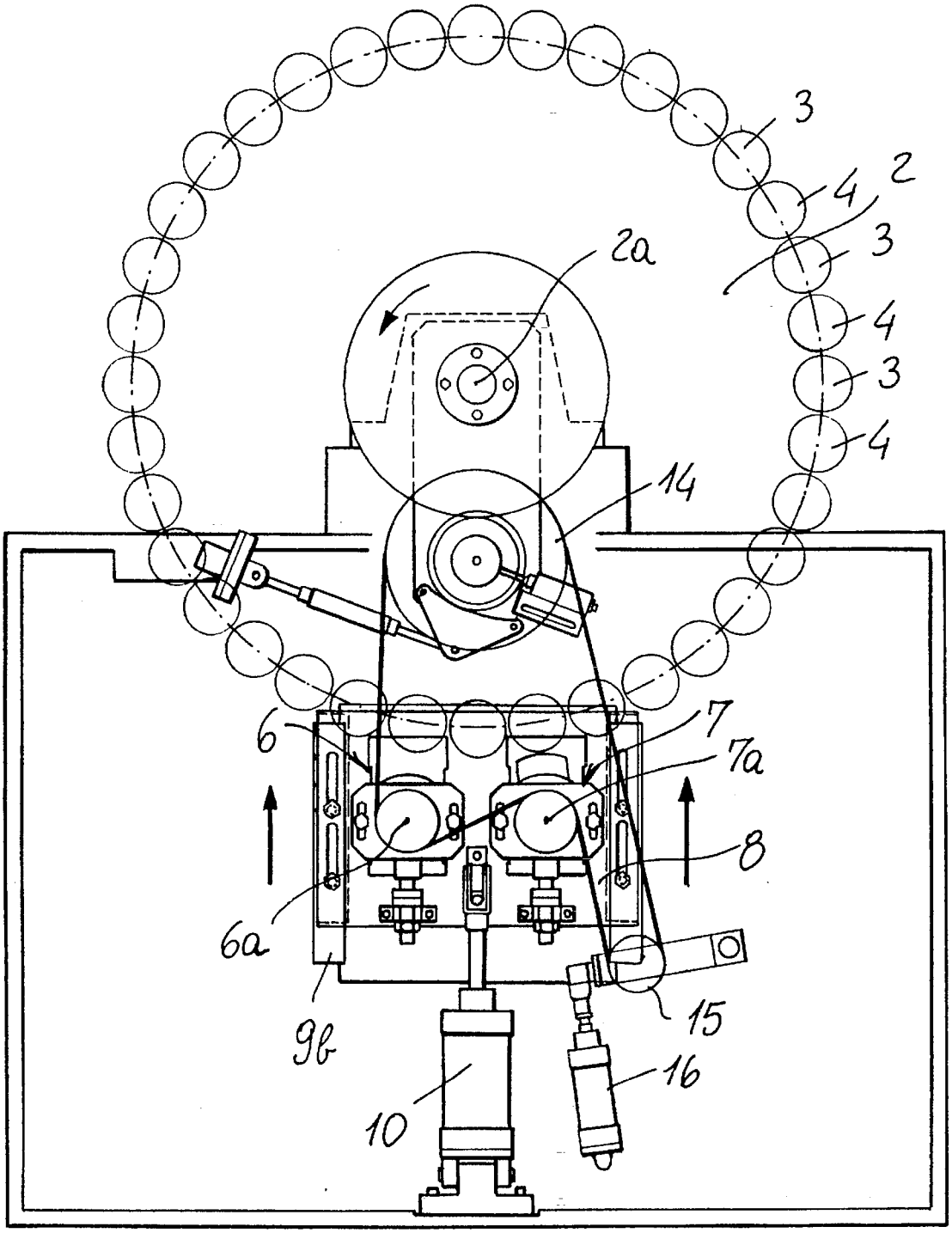
FIG. 1 is a schematic view illustrating the raising machine according to the present invention with the cleaning brushes thereof in their working positions.
Figure 2:
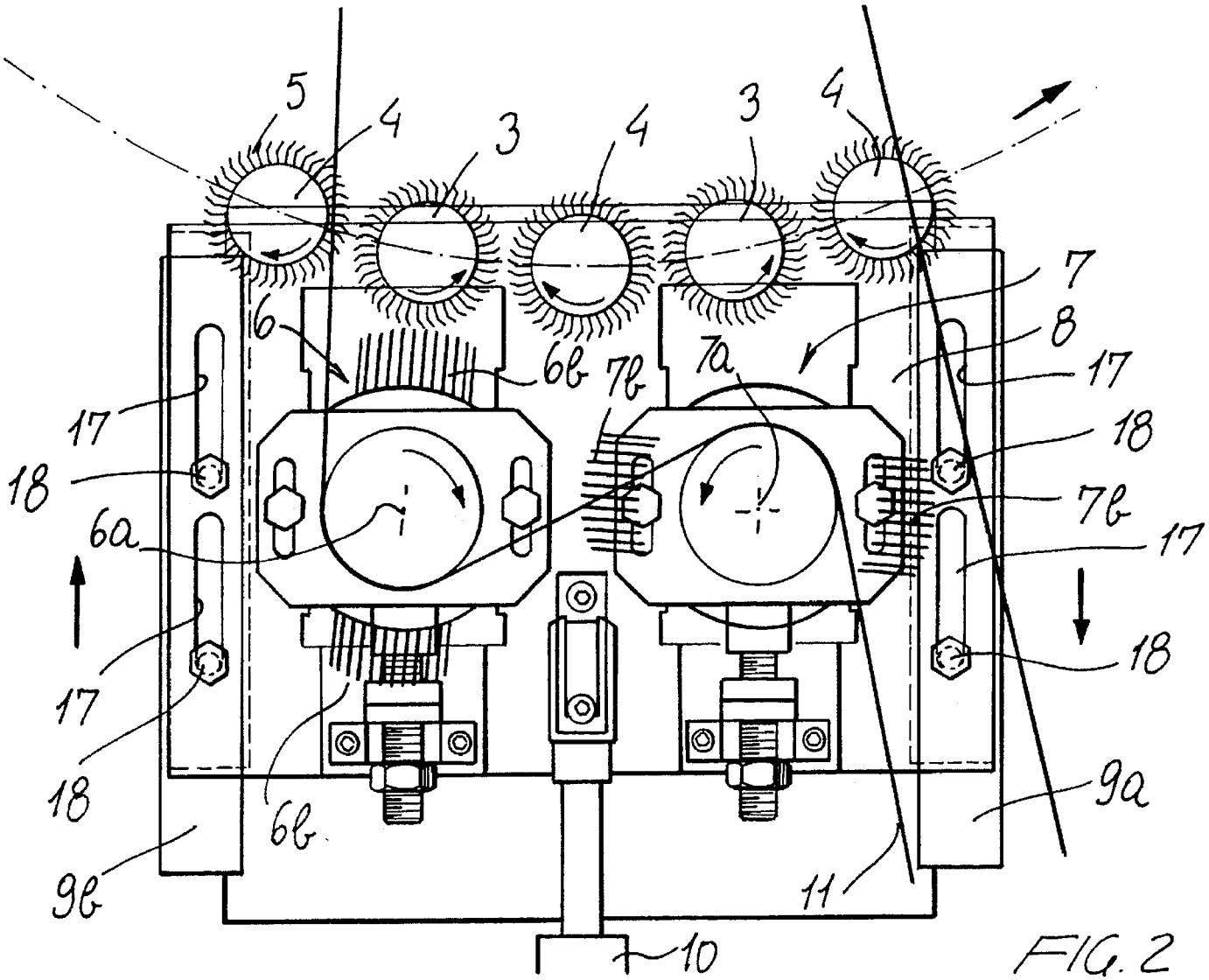
FIG. 2 illustrates an enlarged detail of FIG. 1.
Figure 3:
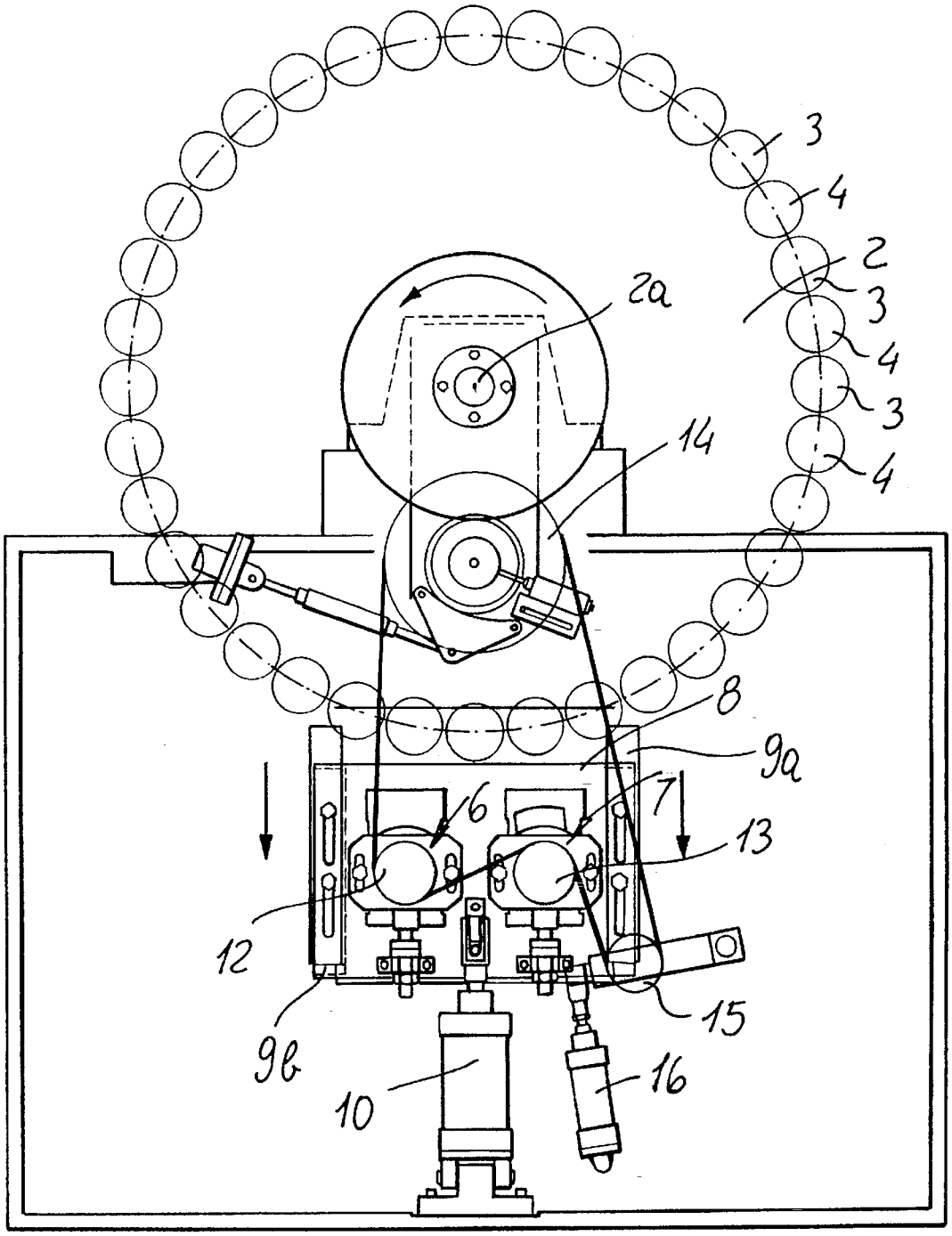
FIG. 3 schematically illustrates the raising machine according to the present invention with the cleaning brushes thereof removed from the raising cylinders.
Figure 4:
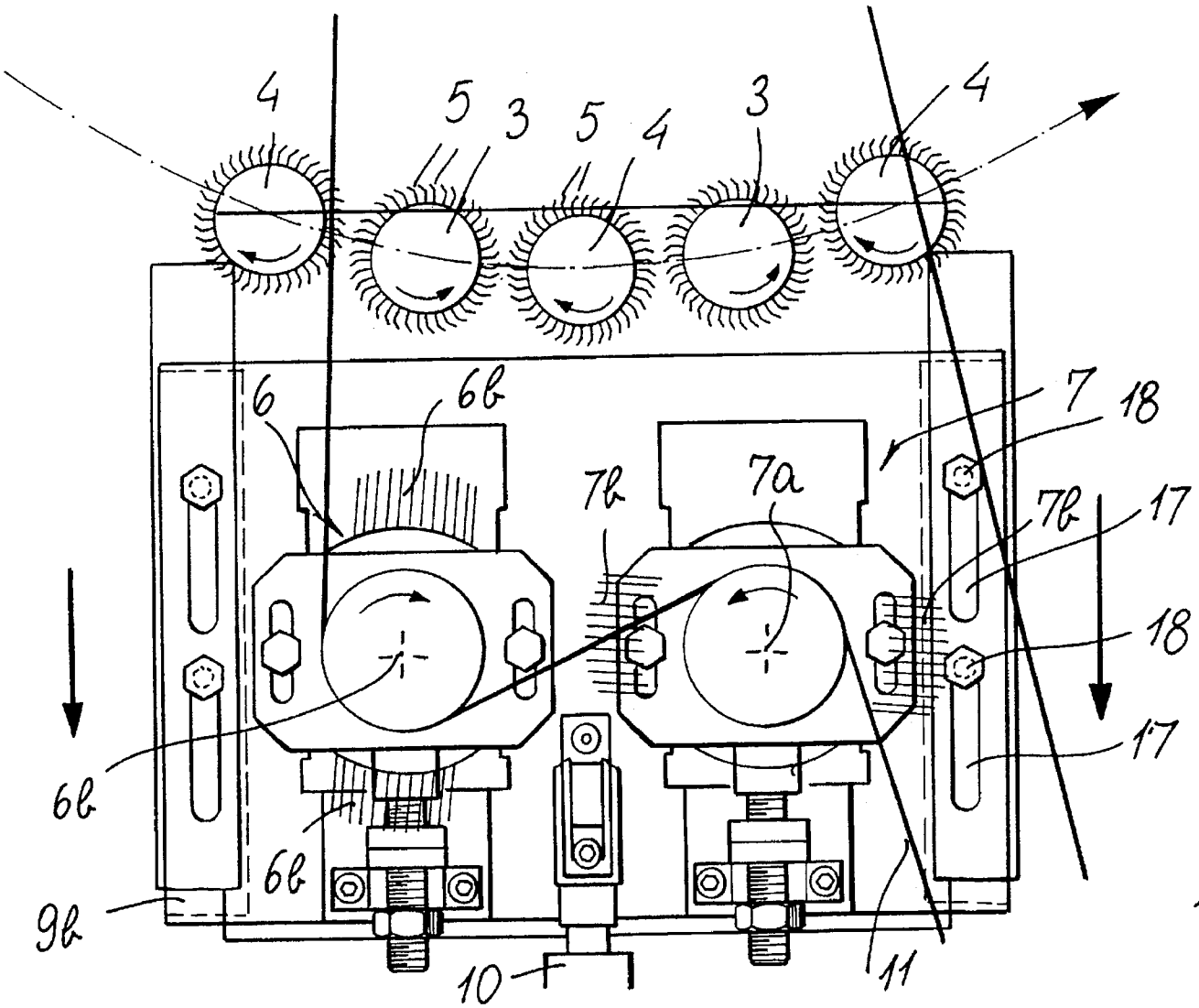
FIG. 4 illustrates an enlarged detail of FIG. 3.

With reference to the number references of the above mentioned figures, the raising machine according to the present invention, which has been generally indicated by the reference number 1, comprises, in a per se known manner, a rotary drum 2, which is rotatably supported about the rotary axis 2*a* thereof, horizontally arranged, and which can be rotatively driven about said axis 2*a*.

The drum 2 supports, on the periphery or mantle thereof, a plurality of raising cylinders 3 and 4 which are rotatably supported about their respective rotary axes, parallel to the axis 2*a* of the drum 2.

The raising cylinders 3 and 4 can be driven by a rotary movement about their respective axes so that, alternately, a raising cylinder 3 is driven in an opposite rotary direction with respect to the rotary direction of the adjoining raising cylinder 4.

Each raising cylinder 3 or 4 is constituted by a supporting cylinder, which is coated by a card clothing 5.

The card clothings 5 of the raising cylinders 3 are arranged with the tips of the teeth thereof oriented in a direction, whereas the card clothings of the raising cylinders 4 are arranged with the tips of their teeth facing an opposite direction, so that the raising cylinders 3 are suitable to provide a raising operation on the fabric being raised, whereas the raising cylinder 4 are suitable to provide a counter-raising operation.

The fabric being raised is caused to be wound on the periphery of the drum 2, so as to contact the raising cylinders 3 and 4, with the exclusion of a bottom portion of the drum 2, therewith are associated in a facing adjoining relationship the cleaning brushes 6 and 7.

As shown, the cleaning brushes 6 and 7 are rotatably mounted about their respective rotary axes 6*a* and 7*a* which are parallel to the axes of the raising cylinders 3 and 4, being supported on a plate-like supporting element 8, which, in turn, can be displaced toward the drum 2 or away from said drum 2.

More specifically, the supporting element 8 is slidably mounted on two vertical opposite sides thereof, along two vertical guides 9*a* and 9*b* in order to be controllably driven along said guides 9*a* and 9*b*, manually or, preferably, by means of a pneumatic or hydraulic cylinder 10.

By causing the plate-like supporting element 8 to slide along the two guides 9*a* and 9*b*, it is possible to displace the cleaning brushes 6 and 7 from a working position, in which they adjoins the drum 2, so as to operate on the card clothings 5 of the raising cylinders 3 and 4 to clean them, to a removed position in order to allow necessary maintenance operations to be performed on the raising machine, in order to prevent damages to the brushes and card clothings of the raising cylinders 3 and 4, as the fabric being raised is accidentally broken.

The cleaning brushes 6 and 7 can be rotatably driven about their respective rotary axes 6*a* and 7*a* and in opposite rotary directions, for example by means of a belt drive 11, or a chain drive, and being provided with cleaning portions respectively indicated by the reference numbers 6*b* and 7*b*.

The cleaning portions, in particular, are suitably offset from one another, so that the cleaning brush 6 will operate exclusively on the raising cylinders 3 providing the raising operation proper, whereas the other cleaning brush 7*b* will operate exclusively on the raising cylinders 4 providing the counter-raising operation.

The belt of chain 11 extends along a driving path, by engaging with two pinions or pulleys 12 and 13 rigid with said cleaning brushes 6 and 7 and with a pinion or pulley 14 which can be driven, in a per se known manner, with a rotary motion about the rotary axis thereof, in order to cause the cleaning brushes 6 and 7 to turn.

Along the path of the belt or chain 11 is provided a tension pulley or roller 15 which is movable, under the action of a pneumatic or hydraulic cylinder 16, in order to properly tension or stretch the belt or chain 11.

Through the supporting element 8 of the cleaning brushes 6 and 7, at the vertical guides 9*a* and 9*b*, are provided slots 17 which vertically extend and which restrain, by interfering with bolts 18 affixed to the guides 9*a* and 9*b* the displacement stroke of the supporting element 8.

In operation, as the fabric being raised is accidentally broken, the supporting element 8 with the cleaning brushes 6 and 7 will be immediately removed or moved away from the drum 2, so as to prevent any damages to the raising cylinder card clothings and to the cleaning brushes 6 and 7.

Moreover, if the raising machine is to be subjected to a maintenance operation, then this maintenance operation can be performed in a very easy manner owing to the fact that the supporting element 8 and cleaning brushes 6 and 7 can be suitably removed from the drum 2.

From the above disclosure and from the observations of the figures of the accompanying drawing, the great functionality and facility of use characterizing the raising machine according to the present invention will be self evident.

In particular, the fact is to be pointed out that a raising machine has been provided which efficiently prevents the raising cylinder card clothings and cleaning brushes from being damaged, as the fabric being raised is accidentally broken, and which will allow maintenance operations to be performed in a very easy manner.

While the invention has been disclosed with reference to a preferred embodiment thereof, it should be apparent that the disclosed embodiment is susceptible to many modifications and variations all of which will come within the scope of the appended claims.

I claim:

1. An improved maintenance raising machine, including a safety device for preventing damages as a fabric being raised is broken, said raising machine comprising a drum, having a horizontal axis, which can be rotatably driven about said axis and supporting, on a peripheral portion thereof, a plurality of raising cylinders, each having an axis parallel to said axis of said drum and which can be rotatively driven about the axes thereof, two cleaning brushes being moreover provided, said brushes adjoining a portion of said periphery of said drum and operating on said raising cylinders for cleaning said raising cylinders, wherein said two cleaning brushes are provided with offset cleaning portions so that a cleaning brush will operate exclusively on said raising cylinders provided for the raising operation proper, whereas the other cleaning brush will operate exclusively on the raising cylinders provided for a counter-raising operation, said two cleaning brushes being mounted on a controllably driven plate-like support element which can be controlled vertically displaced toward said drum or away from said drum, said plate-like support element adjoining a bottom portion of said drum and being vertically slidably mounted on two vertical guides arranged at vertical opposite sides of said plate-like support element.

2. A raising machine, according to claim 1, wherein said plate-like support element is slidably vertically driven toward said drum or away from said drum, along said two guides, by a hydraulic or pneumatic cylinder.

3. A raising machine, according to claim 1, wherein said two cleaning brushes have axes parallel to the axis of said drum and are rotatively driven about their axes by a belt or chain drive, controlled tension means being moreover provided for stretching said belt or chain, wherein said controlled tension means comprises at least a tension roller which can be controllably driven by a hydraulic or pneumatic cylinder.

* * * * *